US006231056B1

(12) United States Patent
Wu

(10) Patent No.: US 6,231,056 B1
(45) Date of Patent: May 15, 2001

(54) BABY WALKER

(76) Inventor: Jung-Chih Wu, PO Box 82-144, Taipei (TW)

( * ) Notice: Subject to any disclaimer, the term of this patent is extended or adjusted under 35 U.S.C. 154(b) by 0 days.

(21) Appl. No.: 09/450,446

(22) Filed: Nov. 30, 1999

(51) Int. Cl.[7] ..... B62B 7/12

(52) U.S. Cl. ..... 280/7.17; 280/1.188; 280/87.051; 280/47.18; 297/5

(58) Field of Search ..... 280/87.05, 87.051, 280/30, 647, 648, 649, 650, 658, 657, 47.38, 7.15, 7.17, 1.188, 47.18; 297/5

(56) References Cited

U.S. PATENT DOCUMENTS

| | | | | |
|---|---|---|---|---|
| D. 268,405 | * | 3/1983 | Hannes et al. | 280/87.051 |
| 2,308,626 | * | 1/1943 | Reinholtz | 280/87.051 |
| 2,986,400 | * | 5/1961 | Phillips | 280/7.15 |
| 5,230,523 | * | 7/1993 | Wilhelm | 280/648 |
| 5,244,443 | * | 9/1993 | Cerda | 280/87.051 |
| 5,261,690 | * | 11/1993 | Kluber | 280/648 |
| 5,318,311 | * | 6/1994 | Bofill | 280/648 |
| 5,441,289 | * | 8/1995 | Spielberger | 280/87.051 |
| 5,794,951 | * | 8/1998 | Corley et al. | 280/30 |
| 5,813,720 | * | 9/1998 | Huang | 297/5 |
| 5,884,922 | * | 3/1999 | Pickering | 280/1.188 |

* cited by examiner

*Primary Examiner*—Michael Mar
(74) *Attorney, Agent, or Firm*—A & J

(57) ABSTRACT

The present invention relates to a dual function baby walker, wherein a supporting frame is mounted at the top of a base seat body which is disposed to the bottom of an upper housing seat including a chamber. When the chamber at the upper housing seat is provided with a chair, the baby can be seated on the chair and the legs of the baby can touch the ground to control the moving direction of the walker. When the baby is standing up, the upper housing seat can be detached from the supporting frame, and the bottom of the upper housing seat is mounted with a plurality of wheel bodies. The top of the upper housing seat is provided with a handle to provide holding for the baby while walking. Thus, the baby walker is suitable to be used for baby at different growth stages such that the baby walker can be functioned as a sitting type of baby walker and a pushing type of baby walker as well.

1 Claim, 6 Drawing Sheets

BABY WALKER

BACKGROUND OF THE INVENTION a) Technical Field of the Invention

The present invention relates to dual function baby walker, and in particular, to a baby walker which allow a baby to be seated or to stand and push while walking. The baby walker is suitable for baby at different walking-learning stages.

b) Description of the Prior Art

Conventional baby walkers are generally divided into two types, i.e. a sitting type baby walker and a pushing type baby walker. In the conventional sitting type baby walker, a plurality of wheels are provided to the base of the baby walker and the baby sits on the chair while his legs can touch the ground. This type of baby walker is suitable for baby at the early stage as the baby does not have strong leg muscle to support his body weight. The pushing type of baby walker has a plurality of wheels at the bottom portion thereof and a handle is provided for holding by the baby. However, this type of baby walker suits only baby when the baby is able to stand on his feet.

As these types of baby walkers are for baby at different stage of growth, a consumer has to buy a sitting-type baby walker before the baby is able to walk and at a later stage, the consumer needs to get other pushing-type baby walker when the baby is about to stand on his feet. Therefore, it is not economical to have two baby walkers at the time when the baby is at the early stage of growth.

The present invention intends to provide a dual-function baby walker for assisting baby to walk without getting two separate baby walkers.

SUMMARY OF THE INVENTION

It is the main object of the present invention to provide a dual function baby walker, wherein a supporting frame is mounted at the top of a base seat body which is disposed to the bottom of an upper housing seat including a chamber. When the chamber at the upper housing seat is provided with a chair, the baby can be seated on the chair and the legs of the baby can touch the ground to control the moving direction of the walker. When the baby is standing up, the upper housing seat can be detached from the supporting frame, and the bottom of the upper housing seat is mounted with a plurality of wheel bodies. The top of the upper housing seat is provided with a handle to provide holding for the baby while walking. Thus, the baby walker is suitable to be used for baby at different growth stages such that the baby walker can be functioned as a sitting type of baby walker and a pushing of baby walker as well.

Yet another object of the present invention is to provide a baby walker, characterized in that the upper housing seat is detachable from the supporting frame and the bottom edge of the upper housing seat is mounted with the wheel bodies, and the chamber is disposed with a bag body, the handle being fixed at the top of the upper housing seat.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
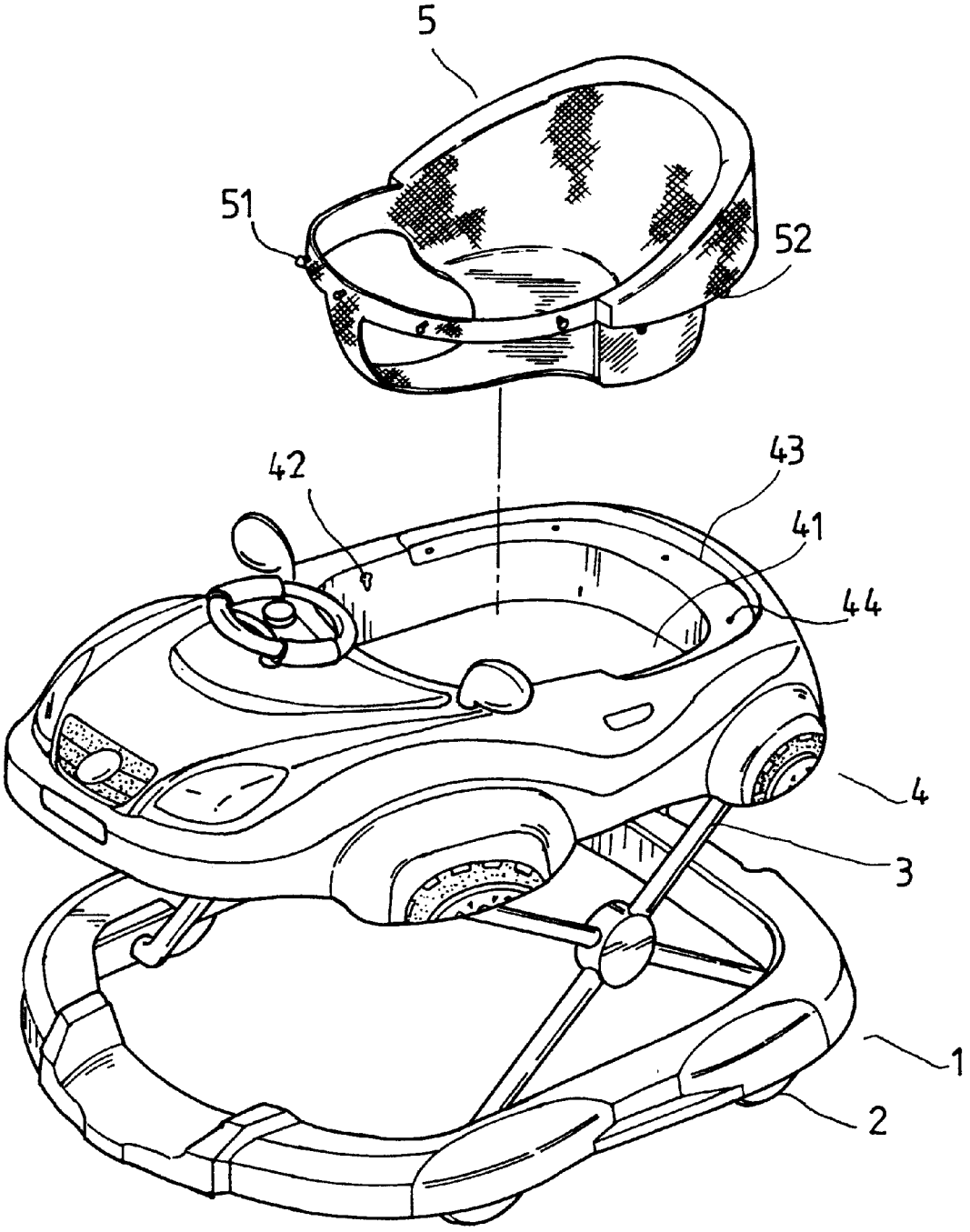
FIG. 1 is a perspective exploded view of a baby walker in accordance with the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
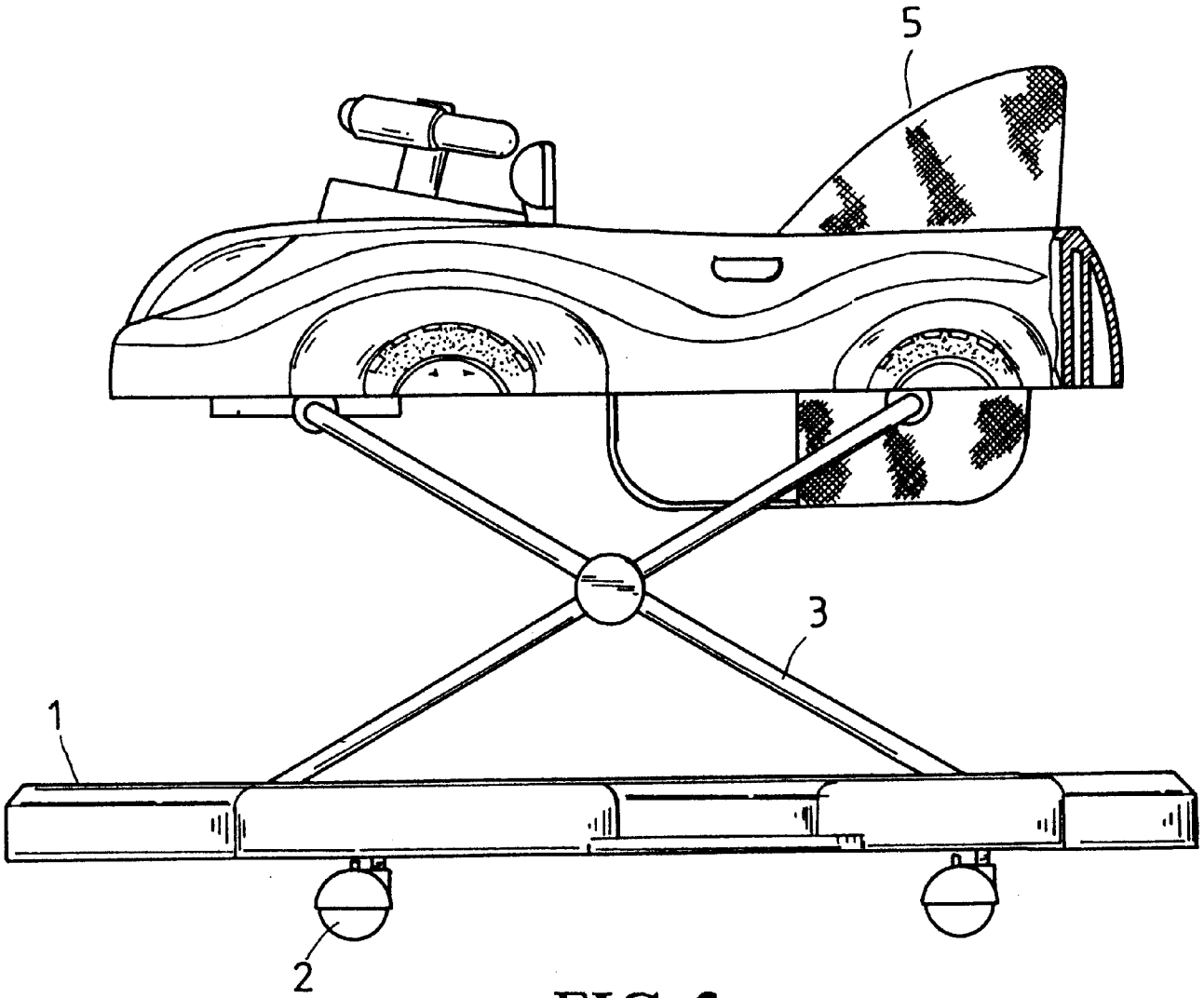
FIG. 2 is an elevational view of a baby walker in accordance with the present invention.
Figure 3:
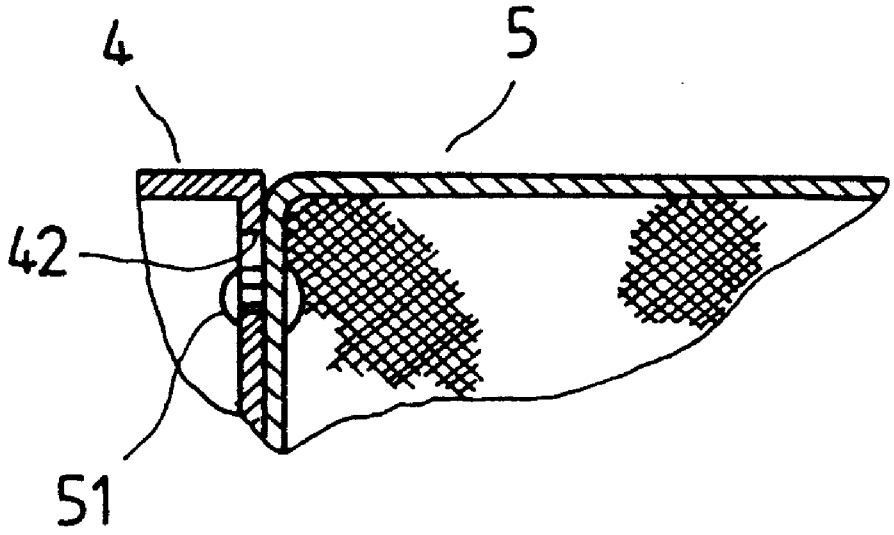
FIG. 3 is a partial sectional view of the upper housing seat and the chair in accordance with the present invention.
Figure 4:
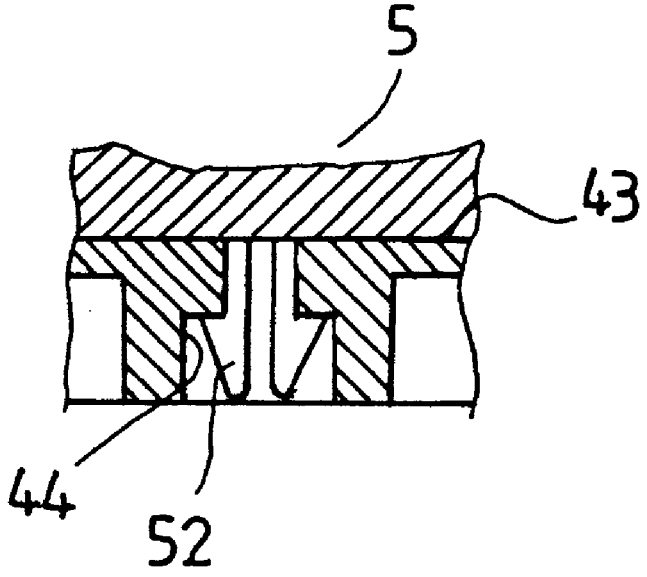
FIG. 4 is a partial sectional view of the chair mounted onto the retaining hole at the upper housing seat in accordance with the present invention.

Referring to FIGS. 1 and 2, a dual function baby walker in accordance with the present invention is generally comprised of a base seat body 1, a supporting frame 3, an upper housing seat 4 and a chair 5, wherein the base seat body 1 is a hollow substantially ring-like structure having a bottom portion being provided with a plurality of wheel bodies 2. The supporting frame 3 is disposed at the top of the base seat body 1, and the shape of he upper housing seat 4 is substantially corresponding to that of the base seat body 1. The rear side of the upper housing seat 4 is provided with a chamber 41 having a front section being provided with a plurality of fixing apertures 42 at the inner wall thereof. The top edge of the rear section of the chamber 41 is provided with a circular slot 43 having a plurality of retaining holes 44, and the outer edge of the chair 5 of the front section is provided with a plurality of fastening elements 51, and the rear section is provided with a plurality of the engaging elements 52 which correspond to the chamber 41 of the upper housing seat 4. Referring to FIGS. 3 and 4, the fastening elements 51 are correspondingly fixed into the fixing apertures 42 and the engaging elements 52 are correspondingly fixed into the engaging holes 44. The baby can be seated on the chair 5 and the legs can touch the ground to control the forward direction of the baby walker.

Figure 5:
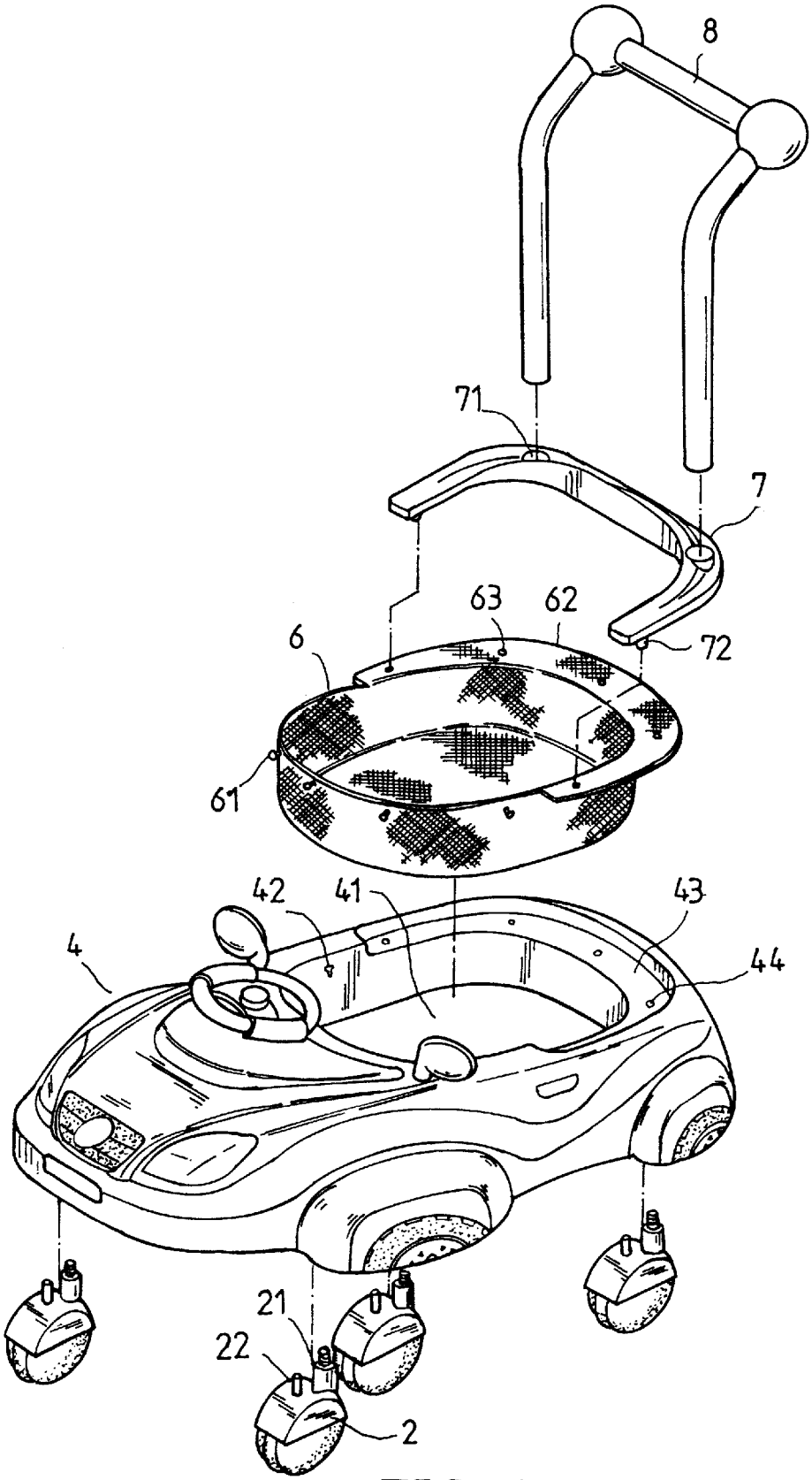
FIG. 5 is a perspective exploded view of another preferred embodiment of a baby walker in accordance with the present invention.
Figure 6:
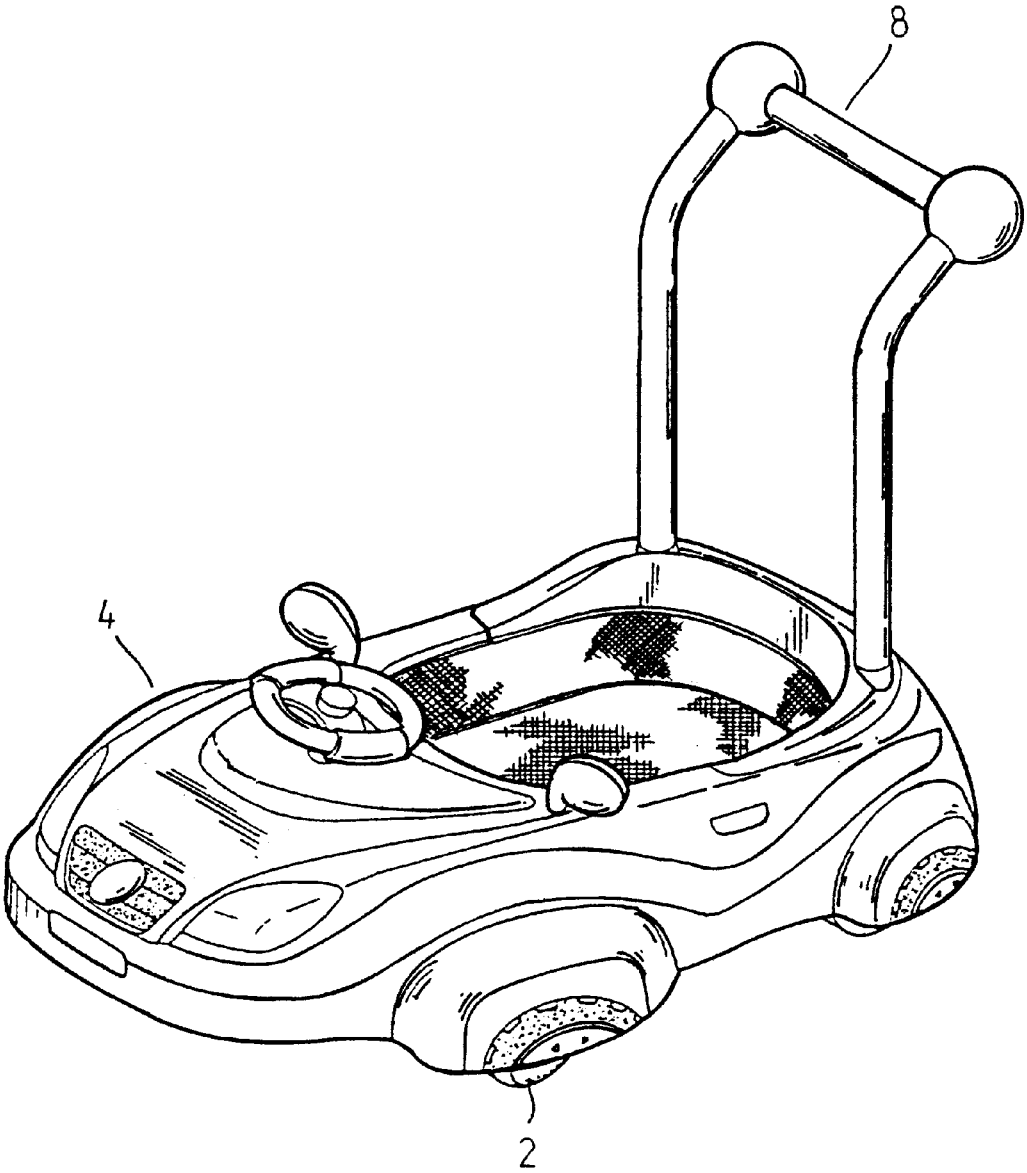
FIG. 6 is a perspective view of another preferred embodiment of a baby walker in accordance with the present invention.
Figure 7:
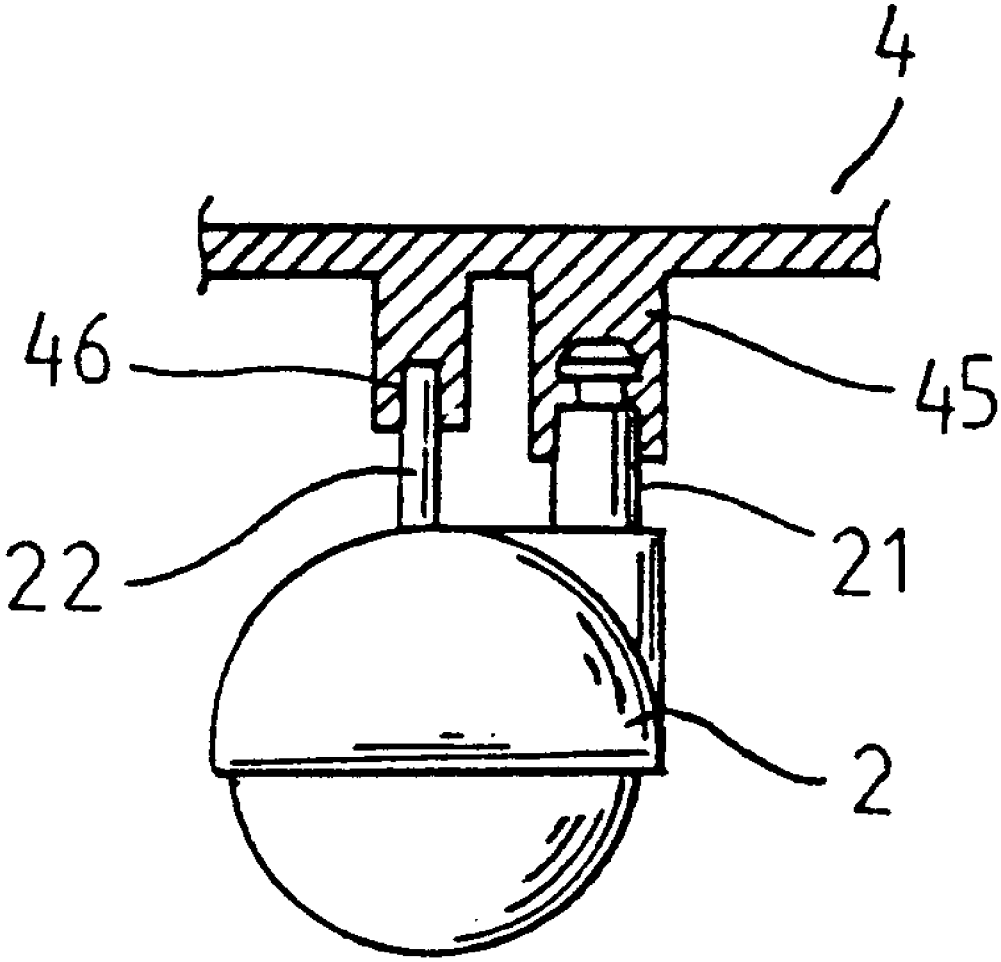
FIG. 7 is a sectional view of the chair together with the wheel body of the baby walker in accordance with the present invention.

When the baby is at the standing stage, the walker can be changed to a pushing-type walker. As shown in FIGS. 5 and 6, the upper housing seat 4 is detached from the supporting frame 3 and the wheel body 2 at the bottom edge of the bottom seat body 1 is mounted at the bottom edge of the upper housing seat 4. As shown in FIG. 7, the top of the body 2 is extended to mount a fixing peg 21 and a direction positioning peg 22. The fixing peg 21 can be inserted into the fixing seat 45 of the upper housing seat 4 and the direction positioning peg 22 is inserted into the engaging seat 46, and the chair 5 at the chamber 41 is detached and a bag body 6 which is sealed at the bottom face thereof is used to substitute the chair 5.

The front section of the external edge is provided with a plurality of fastening members 61 to fasten with the fixing apertures 42 of the chamber 41. The rear section is extended with a protruded edge 62 having a plurality of apertures 63 such that the protruded edge 62 can be flatly mounted to the circular slot 43 of the chamber 41. An arch-shaped plate 7, corresponding to the circular slot 43, is adhered to the upper end surface of the protruded edge 62 such that the protruded peg 72 of the bottom face of the arch-shaped plate 7 can be inserted into the aperture 63 of the protruded edge 62 and in engagement with the engaging hole 44. Two insertion holes 71 are provided at the upper end of the arch-shaped plate 7 such that a handle 8 can be insertably mounted at the insertion holes 71 with its ends. The pushing-type baby walker is shown in FIG. 6. The baby holds the handle 8 to push the baby walker and move forward.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A convertible baby walker comprising:

a hollow ring-shaped base member;

an upper housing member having a plurality of protruding wheel wells formed along outer sidewalls and a chamber formed therein with top and bottom openings;

a supporting frame;

a plurality of wheels;

a seat member having openings for receiving the legs of a baby;

a bag having an outwardly protruding edge portion and a closed bottom;

an arch-shaped plate having a pair of insertion holes; and a handle having a pair of leg portions which are interconnected at upper ends by a transverse portion, wherein the baby walker is convertible between a first configuration in which the plurality of wheels are attached to a bottom surface of the base member, the frame is interconnected between the base member and the upper housing member, and the seat member is mounted within the chamber, and a second configuration in which the plurality of wheels are mounted within respective wheel wells of the upper housing member, the bag is mounted within the chamber with the arch-shaped plate overlying the protruding edge portion of the bag, and lower ends of the pair of leg portions of the handle are received within the pair of insertion holes of the arch-shaped plate.

* * * * *